United States Patent [19]

Anderson

[11] 3,999,658

[45] Dec. 28, 1976

[54] CARTON FOR SUPPORTING APPLIANCES FROM AN UPPER FLANGE

[75] Inventor: Leo J. Anderson, Orange, Calif.

[73] Assignee: Menasha Corporation, Anaheim, Calif.

[22] Filed: Oct. 17, 1975

[21] Appl. No.: 623,865

[52] U.S. Cl. ..... 206/320; 206/326; 229/14 C

[51] Int. Cl.[2] ..... B65D 85/30; B65D 85/64

[58] Field of Search ..... 206/320, 321, 326, 413, 206/414, 416, 448; 229/14 C

[56] References Cited

UNITED STATES PATENTS

| | | | |
|---|---|---|---|
| 3,123,274 | 3/1964 | Burke | 229/14 C |
| 3,486,612 | 12/1969 | Kivell | 206/320 |
| 3,680,688 | 8/1972 | Smith | 206/320 |
| 3,773,171 | 11/1973 | Edsall | 206/320 |
| 3,797,653 | 3/1974 | Goodsite | 229/14 C |
| 3,845,859 | 11/1974 | Dornbush | 206/320 |
| 3,900,101 | 8/1975 | Goodsite | 206/320 |
| 3,918,580 | 11/1975 | Poggiali | 206/320 |

*Primary Examiner*—Stephen P. Garbe
*Assistant Examiner*—Bruce H. Bernstein
*Attorney, Agent, or Firm*—Knobbe, Martens, Olson, Hubbard & Bear

[57] ABSTRACT

A carton is formed of foldable material, such as cardboard, for storing and shipping an appliance, such as a bathtub, which has an upper rim intended to carry a substantial portion of the weight of the appliance, the carton including a vertical column formed of the carton material and having at least one vertical strengthening bend, the column supporting the flange of the appliance from the floor of the carton.

8 Claims, 12 Drawing Figures

FIG. 1.
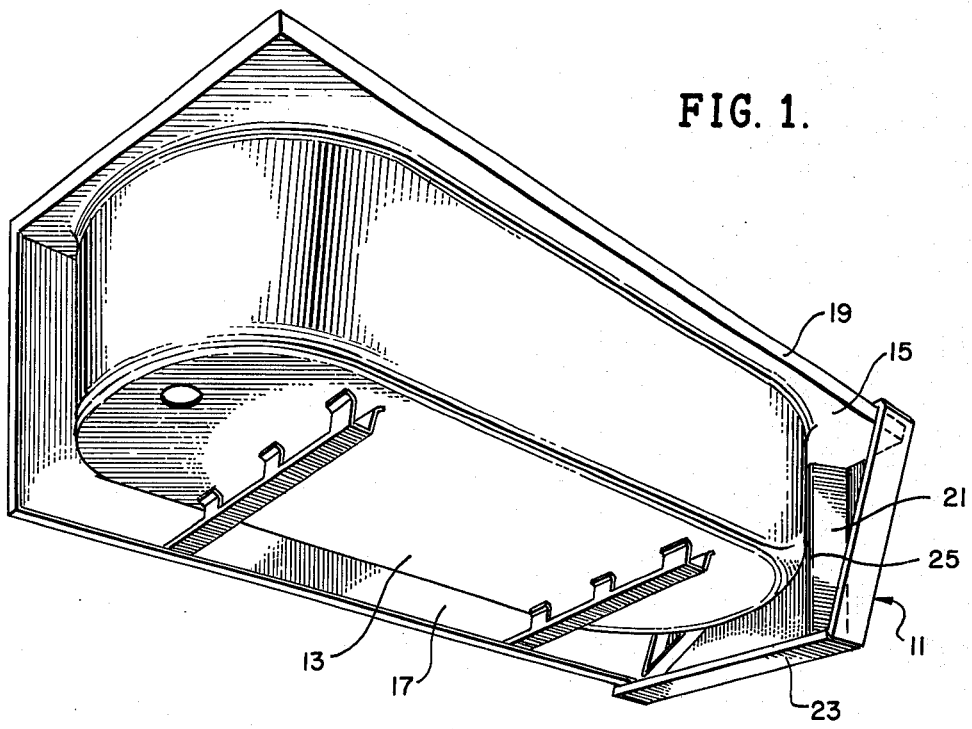
FIG. 2.
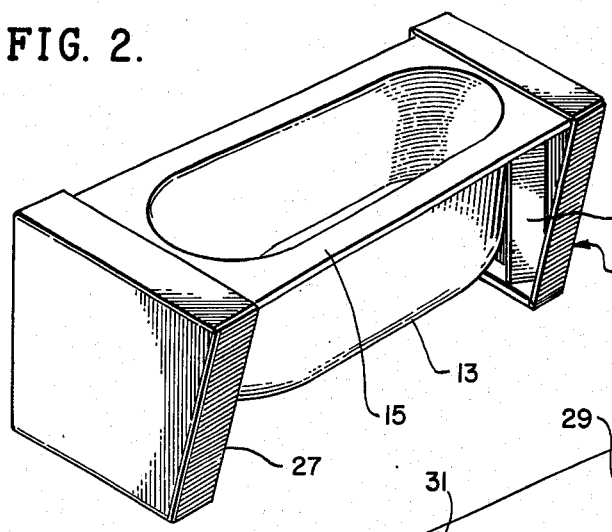
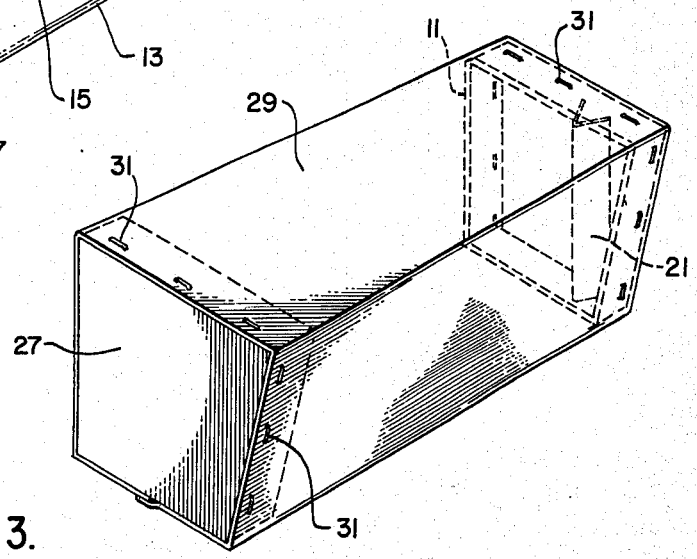
FIG. 3.

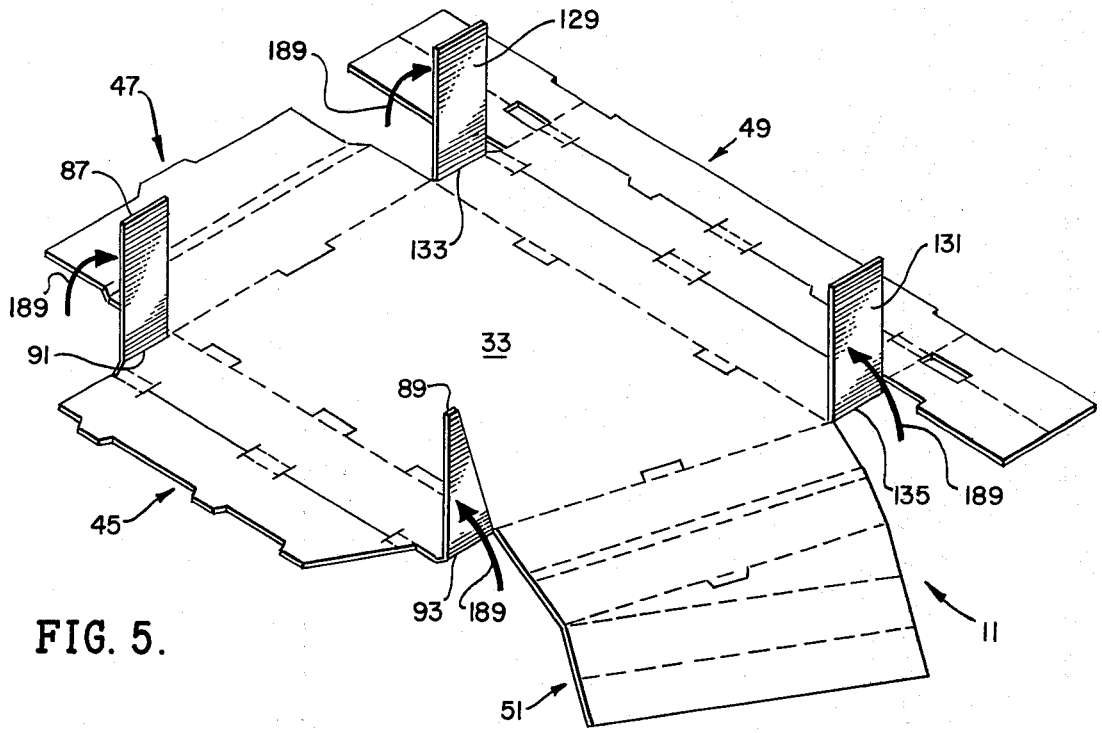
FIG. 5.
FIG. 6.
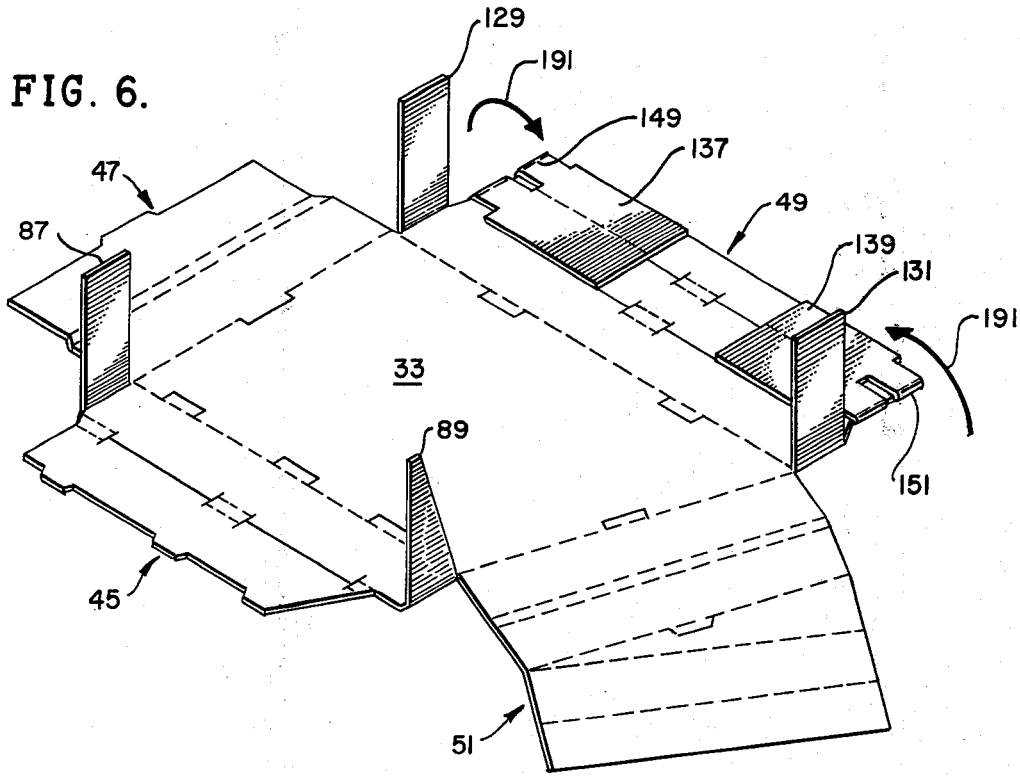

CARTON FOR SUPPORTING APPLIANCES FROM AN UPPER FLANGE

BACKGROUND OF THE INVENTION

The present invention relates to cartons for storing and shipping heavy appliances and, more particularly, to a carton for protecting an appliance which has an upper flange intended to carry a portion of the weight of the appliance.

Most heavy appliances are shipped using a container to protect the painted or otherwise decorative surfaces of the appliance, but stand on their own feet either within a carton or separate from the carton structure. Certain appliances, however, such as bathtubs or sinks, are intended to be installed for final use using a top flange member to support a significant portion of the appliance weight. Such appliances may include feet, but it has been found desirable to ship these appliances using the flange rather than the feet to support at least a portion of the appliance weight. While a number of solutions, such as wooden crating or wooden support columns within a cardboard crate may appear most feasible for supporting the appliance and protecting it from damage during shipment, all such solutions substantially increase the packaging cost and thus the ultimate cost of the appliance to the consumer.

Cardboad boxes by themselves, and particularly unitarily formed cardboard boxes, are generally considered to be too weak to support such a flanged structure from the flange and are therefore used solely for protecting the decorative finish on appliances.

It will be recognized, additionally, that it has become increasingly common in the container art to form cardboard inserts separate from a carton and folded to support certain elements within the carton. Such inserts require separate manufacture and installation during packaging and therefore substantially increase the cost of the container. Even such inserts, however, are normally considered to be too weak to support heavy appliances from an upper flange and are normally used only to position fragile elements within a box structure.

SUMMARY OF THE INVENTION

The present invention provides a unitary carton end structure for supporting heavy appliances from an upper flange within the carton. This is accomplished by providing within the carton end structure a vertical column formed of the foldable material from which the carton itself is constructed, such as corrugated cardboard. The column itself is formed as a hollow structural member which includes at least one vertical fold extending from the flange to be supported to the floor of the box.

As is well known, most lightweight sheet material such as cardboard may be used to form a substantially stronger structural member by folding the sheet material and using the folds to strengthen the sheet material against buckling or bending forces. In the present invention, a heavy appliance is supported by a pair of carton ends, each end unitarily formed and folded to provide a vertical column of folded carton material extending from the floor of the carton end to a position slightly spaced from the top of the carton end. The flange of the appliance to be supported is positioned between the top of this column member and the adjacent top of the carton end, the column supporting the weight from the floor of the carton end. Two such carton ends are employed for supporting a portion of the appliance weight at each end from the upper appliance flange, and a tubular carton wrapper is utilized for supporting the center section of the appliance to protect it from injury and to position the carton ends to maintain the vertical columns therein properly positioned beneath the appliance flange.

While a variety of foldable sheet material may be used for constructing the end covers of the present invention, it has been found that relatively heavy corrugated cardboard stock will support extremely heavy loads when properly formed in accordance with the invention. Thus, for example, the weight of the appliance itself may far exceed the weight of the entire carton structure, and the weight of the end cover and the vertical column will be a very small fraction of the weight supported thereby.

In accordance with the preferred embodiment of the present invention, the vertical column is formed as an extension of a flap which is intended to form one side of the end cover structure. This flap will therefore include at least three fold lines, the two fold lines adjacent the end cover structure being used to permit the flap to form a side for the structure by being folded first to extend from the end cover structure and then folded to return to a position adjacent the end cover structure. The remaining fold line is then used to generate the vertical fold used for strengthening the vertical column within the end cover structure.

The preferred embodiment of the present invention additionally includes means for assuring that the column formed within the end cover structure will remain vertical during use of the carton. This is accomplished by providing a cutout or recessed portion in the floor of the carton end to surround the lower extremity of the vertical column member and thereby prohibit unfolding or dislocation of this vertical member.

These and other advantages of the present invention are best understood through a reference to the drawings, in which:

FIG. 1 is a perspective view of one end of an appliance, and in particular a bathtub, with the end cover of the carton of the present invention installed on one end;

FIG. 2 is an elevation view of the appliance of FIG. 1 with carton ends according to the present invention installed on each end thereof;

FIG. 3 is an elevation view similar to that of FIG. 2 showing the completed carton, with the carton ends interconnected by a tubular sleeve;

Figure 4:
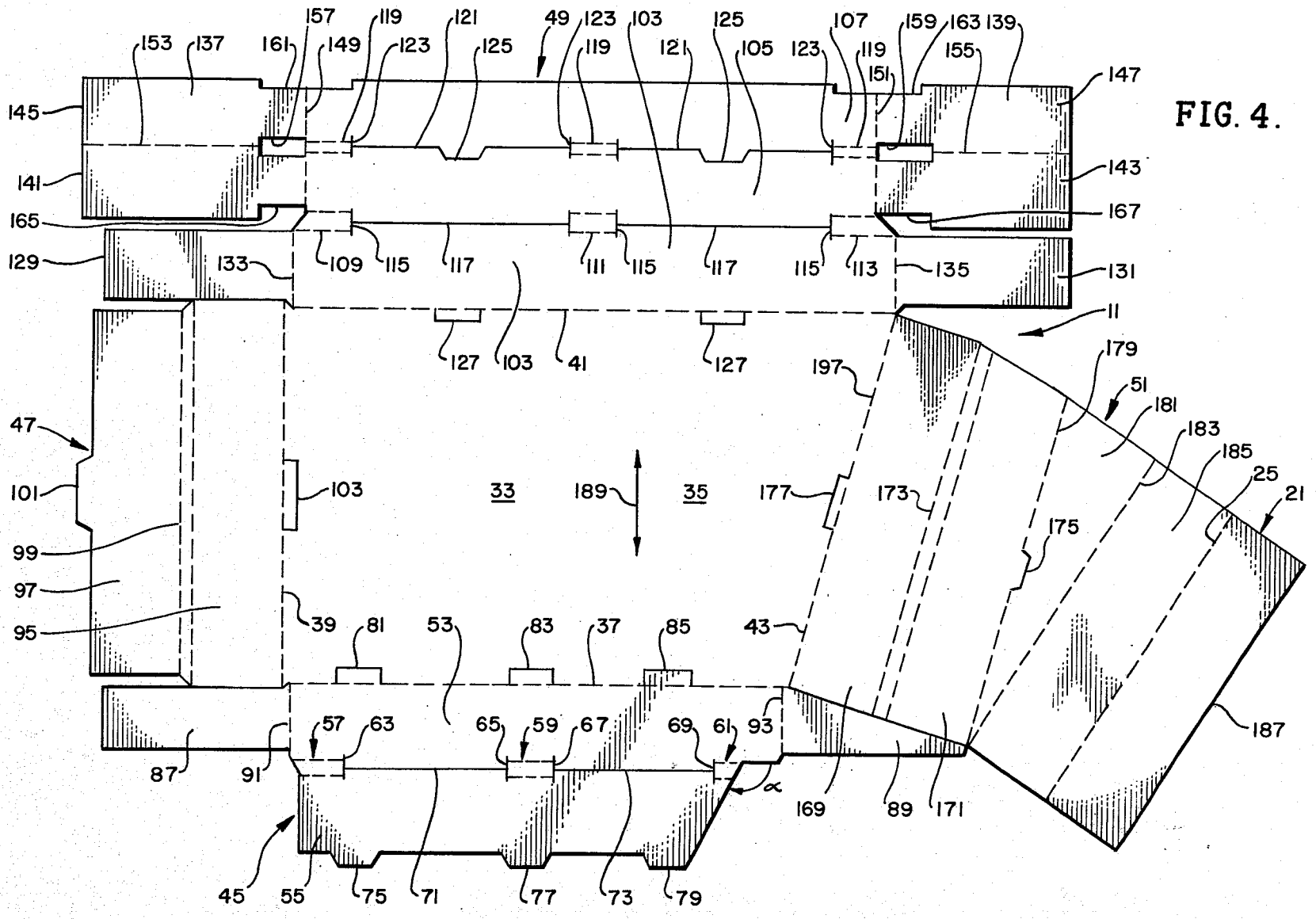
FIG. 4 is a plan view of the carton blank used for forming the carton end shown in FIG. 1.
Figure 10:
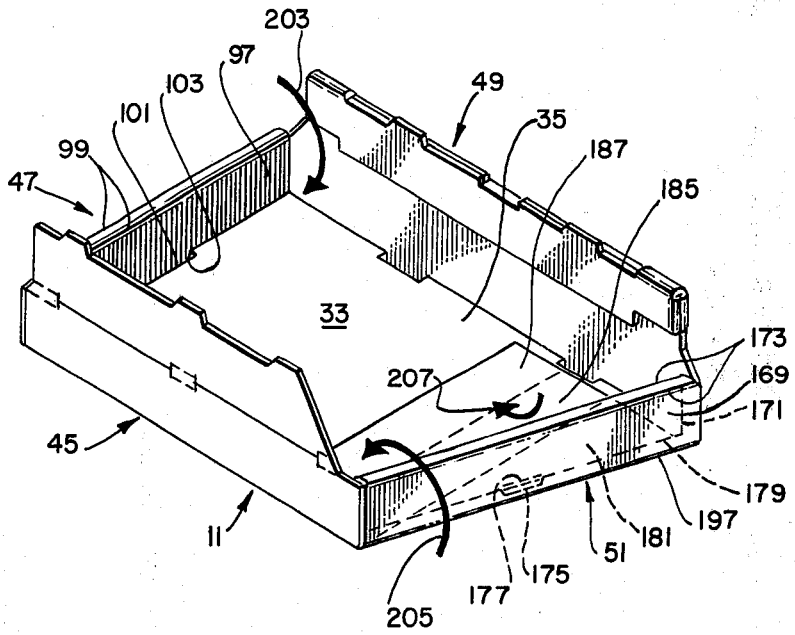
Figure 11:
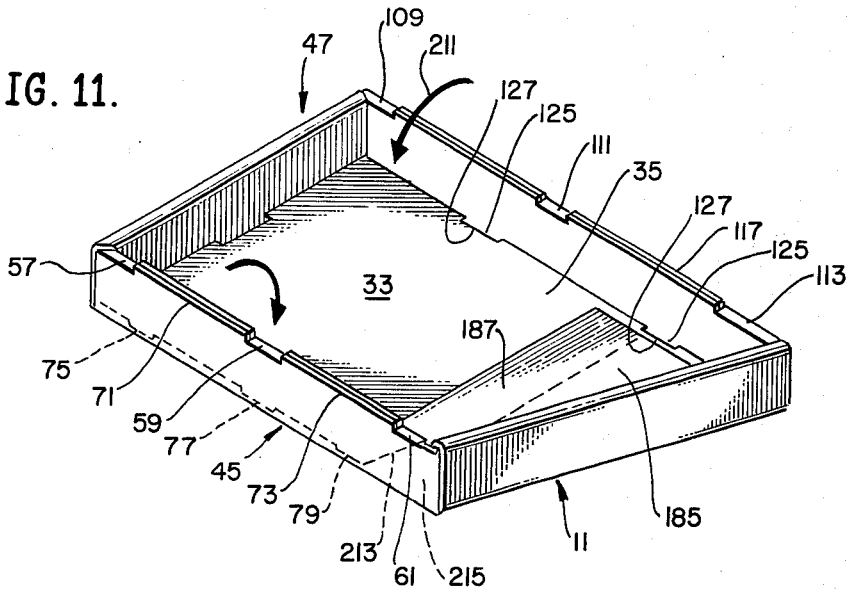
Figure 12:
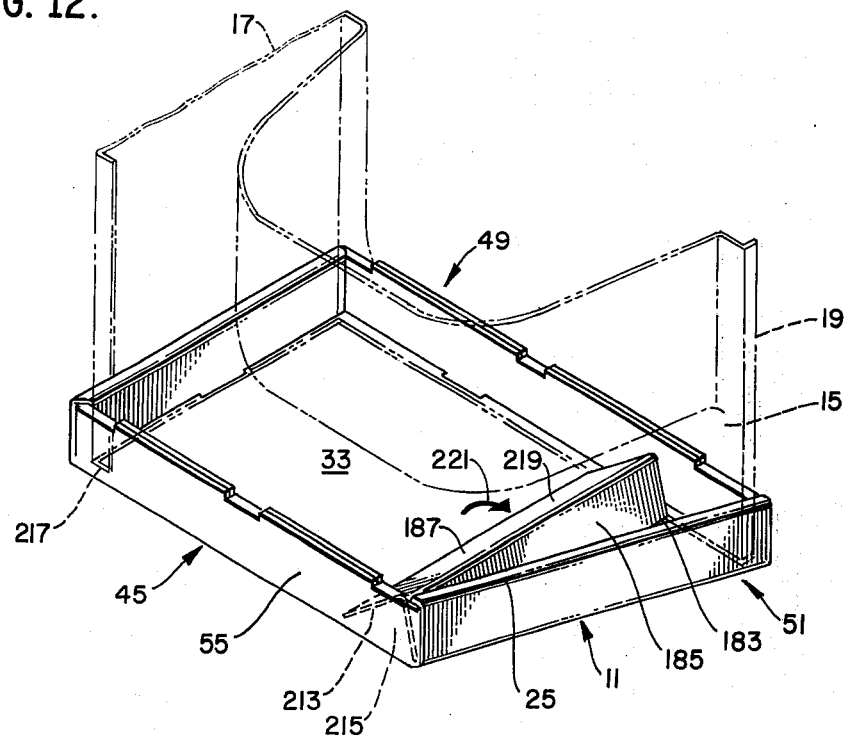

FIGS. 5 through 11 are perspective views taken from within the end cover shown in FIGS. 1 and 4, these views showing the sequential folding of the carton blank of FIG. 4 to form the carton end of FIG. 1; and FIG. 12 is a perspective view similar to FIGS. 5 through 11 and additionally showing, in section, the end flange and apron of the bathtub to be protected installed in the carton end, all to show the last stage in fabricating the carton end of the present invention.

DETAILED DESCRIPTION OF THE PREFERRED EMBODIMENT

Referring initially to FIG. 1, the carton of the present invention includes a carton end 11 which is used to protect and support a flanged appliance such as a bathtub 13 during shipment and storage. The bathtub 13 includes an apron or flange 15 surrounding at least a portion of the upper perimeter of the tub 13. In addition, the tube 13 will commonly include a vertically extending apron 17 which, after installation, will form the finished front of the bathtub 13. The upper flange 15 forms a top wall of the tub 13 surrounding the basin portion thereof and typically includes a plaster flange 19 extending at a right angle above the flange 15 around a portion of the perimeter thereof. While some flanged appliances may be supported by placing them upside down within a carton to sit on the top flange, in the case of sinks or tubs such as that shown, the plaster flange 17 must be protected from damage since any relative bending between the plaster flange 17 and the upper flange 15 often leads to chipping or cracking of the porcelain surface layer thereon, making the tub 13 unacceptable for installation. Thus, while a portion of the weight of the tub 13 is intended to be borne by the flange 15 during both shipment and use, this weight must be borne from beneath the flange 15, that is, with the tub 13 supported in its normal, upright position.

As shown in FIG. 1, a vertical column 21 is formed within the carton end 11 unitarily therewith, and extends from beneath the flange 15 to the floor 23 of the carton end 11. This vertical column 21 forms the heart of the present invention and as shown in FIG. 1 includes at least one vertically extending fold 25 which extends from the flange 15 to the carton floor 23.

As shown in FIG. 2, the carton end 11 is placed over one end of the tub 13 and a second carton end 27, which is formed as a mirror image of the carton end 11, is placed over the opposite end of the tub 13. These carton ends 11 and 27 serve to support the tub 13 solely from the ends thereof, each of the carton ends 11, 27 including a vertical column 21 in accordance with the present invention. These carton ends 11, 27, after placement of the tub 13, are interconnected by a tubular wrapper 29. As shown in FIG. 3, the wrapper 29 is typically formed of relatively heavy gauge corrugated cardboard material and serves to protect the tub 13 from abuse during shipment. The wrapper 29 is folded around the carton ends 11 and 27 to conform therewith and is attached, as by staples 31 with or without glue, to the carton ends 11, 27. While the tubular wrapper 29 does not serve to directly support the tub 13, it does serve to maintain the carton ends 11, 27 properly positioned at the ends of the tub 13 such that the vertical columns 21 will remain engaged beneath the flange 15 of the tub 13 to support the weight of the tub 13.

Referring now to FIG. 4, the carton blank 33 used to form the carton end 11 from a unitary piece of foldable sheet material, such as relatively heavy gauge corrugated cardboard material, will be described. The carton blank 33 includes a flat end wall 35 delineated by four intersecting fold lines 37, 39, 41, 43. Throughout the description of this invention, it should be understood that fold lines, such as the fold line 37, are typically formed in corrugated material by scoring but not cutting the material to facilitate folding along a straight line. The fold lines 37, 39 and 41 are arranged in a perpendicular pattern to form three perpendicular sides for the carton end 11. The remaining fold line 43 interconnects the fold lines 37 and 41 at an angle such that the carton end 11 and the end wall 35 thereof are wider at the top fold line 41 than at the bottom fold line 37. This shape is dictated by the shape of the tub 13 shown in FIG. 1, the flange 15 thereof being wider than the bottom of the tub structure.

Four independent flaps 45, 47, 49 and 51 extend from the end wall 35 at the fold lines 37, 39, 41 and 43, respectively. The flap 45 includes a first flap portion 53 adjacent the fold line 37 having a length which is approximately equal to the length of the fold line 37 and a width which is equal to the depth of the end cover 11 when construction is complete. This flap portion 53 is, in turn, connected to a second outer portion 55 of the flap 45 by three pairs of parallel fold lines 57, 59 and 61. The pair of parallel fold lines 57 extend between one edge of the flap 45 and a short lateral cut 63. Unless otherwise indicated, cuts, such as the cut 63, are indicated by solid lines in FIG. 4, as opposed to the phantom lines, such as the lines 57, used to designate fold lines. These cuts, such as the cuts 63, are slits passing entirely through the blank 33. In a similar manner, the pair of parallel fold lines 59 extend between lateral cuts 65 and 67 and the parallel fold lines 61 extend between the remaining edge of the flap 45 and a lateral cut 69. The lateral cuts 63 and 65 in the flap 45 are interconnected by a cut 71 running along the length of the flap 45 and intersecting with the lateral cuts 63 and 65 approximately midway between the parallel fold lines 57 and 59. Similarly, a longitudinal cut 73 extends between the lateral cuts 67 and 69 midway between the parallel fold lines 59 and 61. While in some instances a pair of longitudinal fold lines extending the entire length of the flap 45 might be adequate for permitting folding of the second flap portion 55 relative the first flap portion 53, the longitudinal cuts 71 and 73 make this folding operation substantially easier by reducing the length of corrugated cardboard material which must actually be folded to the combined length of the fold lines 57, 59 and 61. When folded along the parallel fold lines 57, 59, 61, the flap 45 will separate along the cut lines 71 and 73, the flap portion 55 remaining attached to the flap portion 53 only along the fold line portions 57, 59, 61.

The outer extremity of the flap portion 55 is cut to provide these extending tabs 75, 77 and 79 which are arranged along lines extending perpendicular to the fold line 37 from three rectangularly formed slots 81, 83 and 85, respectively. While shown as cut lines, the slots 81, 83, 85 are cut only through the inner surface layer of the corrugated cardboard blank of the end wall 35 to form pockets for receiving the tabs 75, 77 and 79. Each of the slots 81, 37, 85 includes a first slit parallel to the fold line 83 and slightly spaced therefrom, and a pair of perpendicular slits connecting this first slit to the fold line 37. The slots 81, 83 and 85 are preferably not made all the way through the blank 33 so that, when completed, the outside of the end cover 11 will not show the slots 81, 83, 85.

Extending from the ends of the first portion 53 of the flap 45 are a pair of corner flap members 87 and 89 which are separated from the first flap portion 53 by a pair of fold lines 91 and 93 intersecting normally with the fold line 37. These corner flaps 87 and 89 are intended to fold around the corners of the end cover 11 to strengthen and interconnect the sides thereof, as will be explained in more detail below. The corner flap 87 is rectangular and has a length which is approximately one-half the length of the flap 47. The flap 89 is triangular because of the location of the flap 51 cut from the same blank, and is approximately one-half the width of the flap 51.

The second flap 47 extends from the fold line 39 and is partitioned into a first flap portion 95 and a second flap portion 97 by a pair of closely spaced parallel fold lines 99 which are parallel to the fold line 39. The flap portions 95 and 97 have approximately the same width and length, and the second portion 97 includes an extending tab 101 positioned along a line which is perpendicular with respect to the fold line 39 at the position of a slot 103 cut through one side only of the corrugated cardboard blank 33 in a manner similar to the slots 81, 83 and 85. The slot 103 is sized to receive the tab 101.

Positioned opposite the flap 45 and extending from the fold line 41, the flap 49 includes first, second and third flap portions 103, 105 and 107, respectively, each having a length approximately identical to the length of the fold line 41 and having approximately equal widths. The first flap portion 103 is separated from the second flap portion 105 by three sets of parallel fold lines 109, 111 and 113 interconnected by lateral slits 115 and longitudinal cuts 117 in a manner identical to that described with respect to the interconnection of the first flap portion 53 and second flap portion 55 of the flap 45. The cuts 117 therefore facilitate folding of the second flap portion 105 with respect to the first flap portion 103, the pairs of fold lines 109, 111 and 113 serving to interconnect these portions once folded.

In a similar manner, the third flap portion 107 is suspended from the second flap portion 105 by pairs of longitudinally extending parallel fold lines 119 interconnected by longitudinal cuts 121 extending between lateral cuts 123. In this instance, however, the longitudinal cuts 121 are each formed to provide a tab portion 125 positioned along lines extending normal to the fold line 41 at a pair of slots 127 cut into the upper surface of the carton blank 33 adjacent the fold line 41. The tab portions 125 extend away from the edge of the said third flap portion 107 and form indentations in the edge of the second flap portion 105.

A pair of rectangular corner flaps 129 and 131 extend longitudinally from the first flap portion 103 and are separated therefrom by fold lines 133 and 135, respectively, the fold lines 133, 135 intersecting normally with the fold line 41. The corner flap 129 has a length which is approximately one-half the length of the flap 47, while the corner flap 131 has a length which is approximately one-half the length of the flap 51.

Extending longitudinally from the ends of the second flap portion 105 and third flap portion 107 of the flap 49 are a pair of reinforcing, padding flaps 137 and 139 made up, respectively, of first flap portions 141 and 143 and the second flap portions 145 and 147. The flap 137 is separated from the flap portions 105 and 107 by a fold line 149 intersecting normally with one of the parallel fold lines 109, and the flap 139 is separated from the flap portions 105 and 107 by a fold line 151 intersecting normally with one of the fold lines 113. The flap portion 141 is separated from the flap portion 145 by a fold line 153 which is collinear with the cut 121. Similarly, a fold line 155 separates the flap portion 143 from the flap portion 147 and is collinear with the cut line 121 separating the flap portions 105 and 107. A cutout portion 157 extends along the fold line 153 parallel with the fold lines 119 to permit the flap portions 107 and 105 to be folded along the fold line 119 after the flap 137 has been folded against the flap portions 105 and 107. A similar cutout portion 159 forms an extension of the fold lines 119 at the intersection of the flap portions 143 and 147 to permit the folding of the flap portions 105 and 107 along the fold lines 119. In an identical manner, cutout portions 161 and 163 positioned at the outer edge of the flap 49, and cutouts 165 and 167 positioned along the edge of the flap portions 141 and 143, respectively, opposite the cutout portions 161 and 163, permit a folding of the second flap portion 105 with respect to the first flap portion 103 along the fold lines 109, 111 and 113. Thus, without the cutout portions 157, 159, 161, 163, 165 and 167, the pairs of parallel fold lines 119, 109, 111, 113 would be forced to fold between the parallell fold lines rather than along the independent parallel fold lines.

Extending from the fold line 43 opposite the flap 47, the flap 51, which is used to form one side of the end cover 11, extends to form the vertical column 21 which forms an essential element of the present invention. This flap 51 includes first and second flap portions 169 and 171 separated from one another by a pair of parallel fold lines 173 extending parallel to the fold line 43. The second flap portion 171 is provided with a cut tab 175 extending outwardly therefrom at a position along a line perpendicular from the fold line 43 at a point centered on a slot 177. The slot 177 is formed in a manner identical to the slot 81, that is, by cutting part way through the corrugated material used for the blank 33. Except for that portion which is cut to form the tab 175, the second portion 171 of the flap 51 is interconnected by a fold line 179 with a triangular spacing portion 181. This spacing portion 181, as will be understood in more detail through the further explanation below, is used to assure that the column 21 is positioned vertically within the carton end 11, that is, parallel to the fold line 39. The triangular spacer portion 181 is, in turn, connected by a fold line 183 to a pair of flap portions 185 and 187 which form the vertical column member 21 described in reference to FIG. 1. These flap portions 185 and 187 are separated by the fold line 25, also explained in reference to FIG. 1, which is used to strengthen the vertical column 21. It should be noted that the corrugations in the material used to form the blank 33 are directed along a center line 189 so that the corrugations extend diagonally across the flap portions 185 and 187. Since the flap portions 185, 187 must withstand a substantial vertical load along the fold line 25, it is advantageous to maintain the corrugation axis either parallel to or diagonal across the fold line 25, that is, not normal to the fold line 25, as this latter orientation may weaken the column 21. Stated differently, the corrugation axis should have a direction vector in the direction of the fold line 25.

Referring now to FIGS. 5 through 11, the successive steps used in forming the carton end 11 from the carton end blank 33 will be described. Initially, as shown in FIG. 5, the corner flaps 87, 89, 129, 131 are folded in a direction shown by the arrows 189 about the fold lines 91, 93, 133, 135, respectively. These corner flaps 87, 89, 129, 131 are folded to a position which is approximately normal to the plane of the carton blank 33.

Next, as shown in FIG. 6, the padding flaps 137 and 139 are folded in a direction shown by the arrows 191 about the fold lines 149 and 151, respectively. These flaps 137 and 139 are folded 180° about the fold lines 149 and 151, respectively, to lie flat on top of the remainder of the flap 49.

Figure 7:
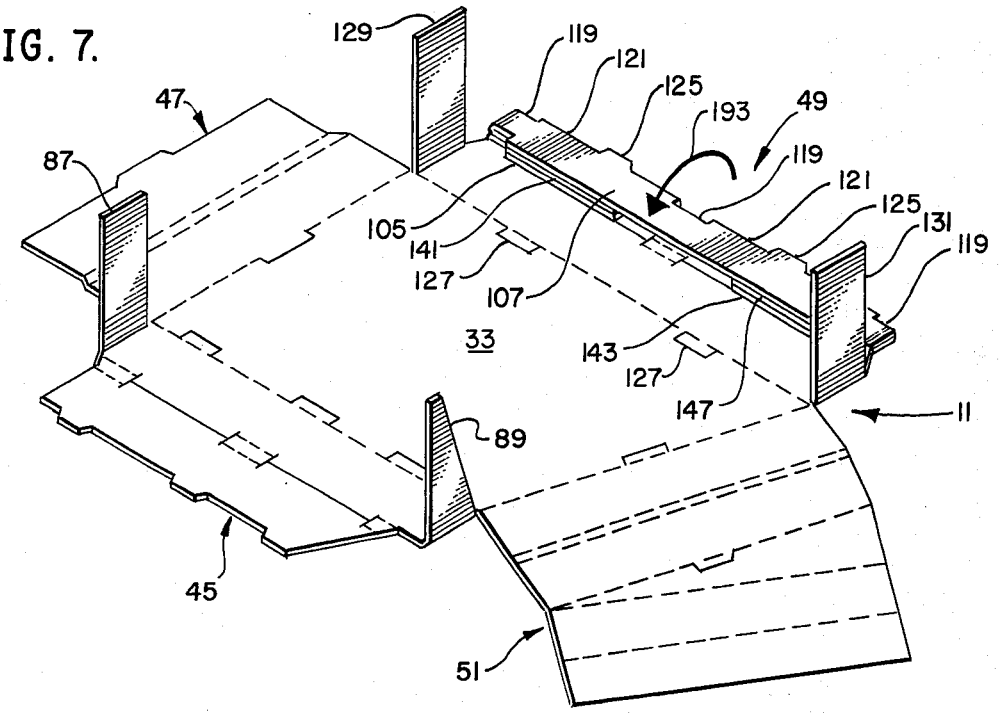

Next, as shown in FIG. 7, the third flap portion 107 of the flap 49 is folded in a direction shown by the arrow 193 about the parallel fold lines 119. It will be understood that in such a fold each of the spaced parallel fold lines 119 folds to approximately a 90° angle to permit the third flap portion 107 to lie flat on the second flap portion 105 (FIG. 4). At the same time, the cut line 121 facilitates this folding, and the tab portions 125 which form a part of the cut line 121 rotate to extend beyond the cut line 121 in line with the slots 127. It will be recognized that since, as shown in FIG. 6, the flap portions 137 and 139 have been previously positioned flat on the flap 49, these flaps 137 and 139 will be folded beneath the flap portion 107 so that they reside between the flap portions 105 and 107. Thus, when the fold shown in FIG. 7 is completed, the outer edge of the flap 49 will be made up at one end from the four layers formed by the flap portion 105, flap portion 141, flap portion 145 and flap portion 107. Similarly, the outer extremity of the remaining end of the flap portion 49 will be made up of a four-layer stack of corrugated material comprising the flap portion 105, flap portion 143, flap portion 147 and flap portion 107.

Figure 8:
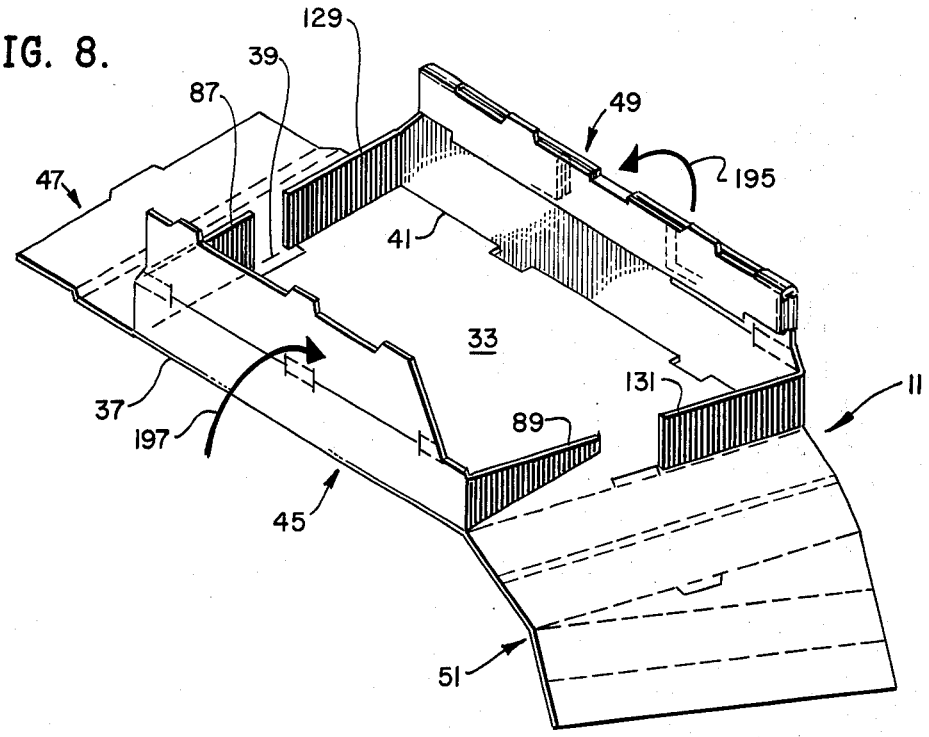

As shown in FIG. 8, the flaps 49 and 45 are next bent along the fold lines 41 and 37, respectively, in the directions shown by the arrows 195 and 197, so that these flaps extend at a right angle from the carton blank 33. As these flaps 49, 45 are so positioned, the previously positioned flaps 87, 89, 129, 131 rotate to the positions shown adjacent the fold lines 39 and 43, confronting the flaps 47 and 51. As will be recognized, these flaps 87, 89, 129, 131 remain in planes which are normal to the plane of the carton blank 33 and will serve to strengthen the corners of the carton end 11. It will also be recognized that each of the flaps 49 and 45 contain two remaining flap portions. The carton 49 includes the flap 103 and the combined extending portion made up of the second and third portions 105 and 107 as well as the flaps 141 through 147. The other flap 45 includes the first flap portion 53 and the second flap portion 55. These flap portions will later be bent to form the upper and lower side wall portions of the carton end 11, as will be described in reference to FIG. 11.

Figure 9:
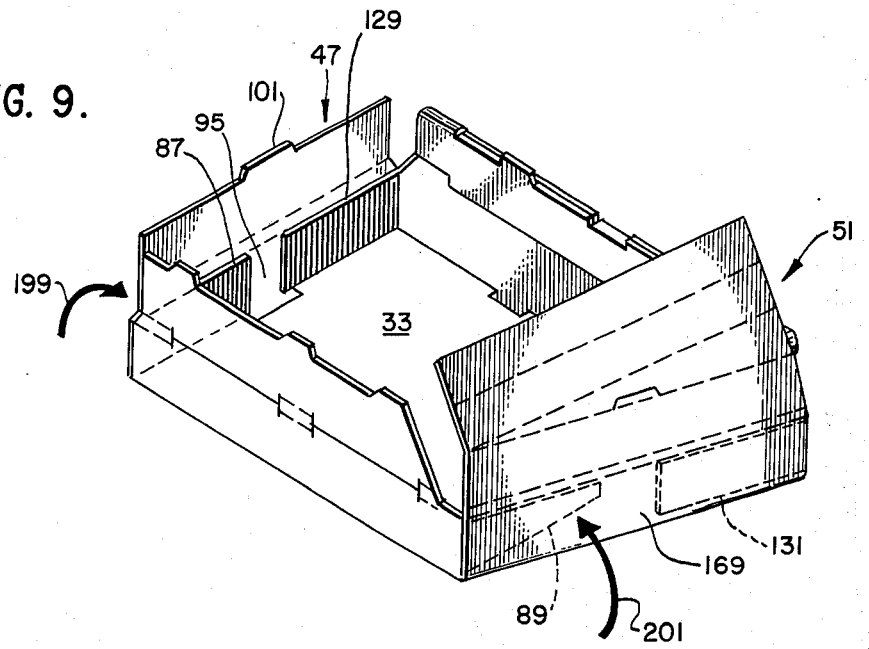

Referring first to FIG. 9, the remaining two flaps 47 and 51 are bent at a right angle relative the carton blank 33 about the fold lines 39 and 41, respectively, as shown by the arrows 199 and 201, so that these flaps 47 and 51 are positioned with their innermost portions, that is, portions 95 and 169, respectively, adjacent the corner flaps 87, 129 and 89, 131, respectively.

Referring now to FIG. 10, the next step includes a folding of the flap 47 about the parallel fold lines 99 and the simultaneous insertion of the tab 101 into the slot 103, as shown by the arrow 203. When this fold about the parallel fold lines 99 is accomplished, the corner flaps 87 and 129 (FIG. 9) are tucked between the portions 95 and 97 of the flap 47. It will be recognized, therefore, that, since the flaps 87 and 129 are a part of the flaps 45 and 49, respectively, this placement of the corner flaps 87 and 129 within the folds of the flap 47 maintains the respective flaps 45, 47 and 49 each normal to the carton blank 33 and serves to form a corner for the carton end 11. At the same time, the insertion of the tab 101 into the slot 103 prohibits unfolding of the tab 47 about the parallel fold lines 99, so that the side of the end carton 11 formed by the flap 47 is retained in the position shown in FIG. 10 during use.

Also shown in FIG. 10 is the subsequent folding of the flap 51 simultaneously about the parallel fold lines 173 and the fold line 197, as shown by the arrows 205 and 207, placing the portions 169 and 171 of the flap 51 flat against one another and the flap portions 181, 185 and 187 flat against the end wall 35 of the carton blank 33. As the fold is made about the fold line 197 separating the flap portions 171 and 181, the tab 175 cut along the fold line 179 extends from the flap portion 171 and is forced to enter the slot 177 in the end wall 35 to maintain the fold along the fold lines 173 during use. At the same time, the interconnection of the tab 175 in the slot 177 maintains the spacer portion 181 of the flap 51 abutted against the side wall formed by the portions 169 and 171 of the flap 51.

As with the flap 47, the previously described folds in the flap 51 will tuck the corner flaps 89 and 131 of the flaps 45 and 49, respectively, between the double wall thickness of the side wall formed by the flaps 51, forming the two remaining corners of the carton end 11 and serving to maintain the side wall formed by the flap 51 positioned normal to the end wall 35.

The basic construction of the carton end 11 is completed by the folds shown in FIG. 11. Initially, as shown by the arrow 209, the outer portion 55 of the flap 45 is folded 180° with respect to the inner portion 53 of the flap 45 about the parallel fold lines 57, 59 and 61 and the cuts 71 and 73, simultaneously positioning each of the tabs 75, 77 and 79 in the respective slots 81, 83 and 85 to maintain the folded configuration of the flap 45. In addition, a fold shown by the arrow 211 is made about the fold lines 109, 111 and 113 and the cuts 117 so that the innermost portion 103 of the flap 49 is laid flat against the remaining portions 105 and 107 of the flap 49. Simultaneously, the tabs 125 are tucked into the slots 127 to maintain the fold shown by the arrow 211. It will be recognized that the flap 49 therefore forms a five-layer upper wall for the carton end 11, these layers at the end adjacent the flap 47 comprising flap portions 103, 105, 107, 141 and 145 and the layers adjacent the flap 51 comprising the flap portions 103, 105, 107, 143 and 147. This substantial thickness of the upper wall of the carton end 11 formed by the flap 49 serves to protect the upper flange of the bathtub 13, as will be described in more detail below.

It will be noted in reference to FIG. 4 that one edge 213 of the portion 55 of flap 45 is formed at an angle $\alpha$ relative the cut lines 71 and 73. When the carton end 11 is folded as shown in FIG. 11, this edge 213 forms a pocket 215 resulting from the reduced wall thickness of the lower wall of the carton end 11 beyond the edge 213. This pocket 215 is triangular in shape and is formed to fit and receive the column 21 shown in FIG. 1, as explained below. The remaining portion of the outer edge of the flap portion 55 abuts against the upper surface of the flap portion 187 to hold the flap portion 187 and flap portion 185 flat against the end wall 35 of the carton end 35.

With the carton end 11 configured as shown in FIG. 11, it is placed over the end of the bathtub 13 as shown in FIGS. 1 and 12. In particular, the side apron 17 which includes a bottom flange 217 is positioned to abut against the side wall formed by the flap 47, the flange 217 abutting one end of the bottom wall formed by folding the flap 45. The upper plaster flange 19 which extends from the apron 15 of the bathtub 13, as previously described, is relatively fragile and is abutted against the five-layer top wall formed by folding the flap 49, this substantial thickness of corrugated material providing adequate protection for the plaster flange 19. The flange 15 of the bathtub 13 is intended to support a substantial portion of the weight of the bathtub 13, the remaining weight supported by the flange 217 of the apron 17. This is accomplished in the present invention by folding the flap portions 185 and 187 of the flap 51 to form a triangular vertical column 21 including a vertical fold 25 beneath the flange 15 and extending from the flange 15 to the bottom carton wall formed by the flap 45. The triangular column 21 is formed after the end of the bathtub 13 is placed into the carton end 11 by grasping the outer edge 219 of the flap portion 187 and sliding this edge in a direction shown by the arrow 221 toward the side wall formed by the flap 51. This sliding will tend to buckle the flap portions 185 and 187 about the fold line 25, and simultaneously buckle the flap portions 185 and 181 about the fold line 183, so that the spacer portion 181 remains flat against the end wall 35 of the carton blank 33 while the portions 185 and 187 form the column 21. Once the edge 219 has been slid along the end wall 35 a predetermined distance, the edge of the flap portion 187 will engage behind the sloping edge 213 of the flap portion 55 so that the triangular column 21 will snap into the pocket 215 previously formed. This pocket 215 and edge wall 213 therefore maintain the portions 185 and 187 bent about the fold line 25 so that, during use, the column 21 will remain folded. It will be understood that the fold line 25 running vertically from the lower wall of the carton 11 to the flange 15 substantially increases the resistance of the flap portions 185 and 187 to buckling under the weight of the bathtub 13 so that a rigid support is provided for the flange 15 thereof. It can be seen from FIGS. 1 to 12 that the spacer flap portion 181 of the flap 51 is formed to provide a vertical column 21 in an irregularly shaped carton end 11, while still permitting the column 21 to be formed unitarily with the carton blank 33.

Referring again to FIGS. 2 and 3, it will be seen that, after the carton end 11 has been placed on one end of the bathtub 13 and the vertical columm 21 formed by snapping the column members into the pocket formed in the lower wall of the carton end 11, a mirror-image carton end 27 is placed on the other end of the bathtub 13 and a similar vertical folded column is positioned beneath the flange 15 of the tub 13 on this end. It will be appreciated that the remaining carton end 27 is made from a blank which is a mirror image of the blank shown in FIG. 4 and results in a carton end 27 which is a mirror image of the carton end 11 shown in FIG. 12. This pair of carton ends 11, 27, once positioned on the bathtub 13, is interconnected by a tubular wrapper 29, preferably formed of corrugated cardboard material, which is wrapped about the respective corners of the carton ends 11 and 27 and attached thereto by the staples 31 with or without glue. This provides an assembled carton for the bathtub 13 protecting it in all directions from damage. In addition, the interconnection of the carton ends 11 and 27 by the wrapper 29 assures that the columns 21 will remain vertically positioned beneath the flange 15 of the tub 13 to support the tub 13 from the floor of the respective carton ends 11 and 27. The substantial thickness of the upper wall formed from the flap 49 (FIG. 12) serves to protect the plaster flange 19 from damage during shipment.

It will be appreciated that, by varying the size and shape of the spacer flap portion 181, the column 21 may be made vertical in a variety of carton sizes and shapes, the spacer portion 181 being removed entirely in a rectangular carton end 11 or being made rectangular in such a carton end 11 if the column 21 is to be centrally spaced in the carton end 11. It is important, however, that this column 21 be formed with at least one vertically extending fold 25 to protect the column 21 from buckling under the weight of the enclosed fixture 13. It will likewise be recognized that this invention is most useful where a fixture, such as a bathtub 13, is intended to be supported during storage and shipment from an upper weight supporting flange, the column 21 providing support for this flange from the floor of the carton ends 11, 27.

What is claimed is:

1. A unitary carton end for supporting a fixture for shipment and storage in a normal, upright orientation, said fixture having normal top and bottom sides and including a weight bearing flange which extends laterally from said said carton end fixture adjacent the normal top of said fixture, comprising:

a vertical wall having a normal top and bottom edge, and two sides, said wall formed of sheet material;

a partial bottom floor wall formed of sheet material extending from said normal bottom edge of said vertical wall and positioned adjacent said normal bottom of said fixture; and a hollow vertically extending column formed unitarily of sheet material with said carton end wall, said vertically extending column abutting said bottom floor wall at one end and said upper weight bearing flange at the other end, said column having at least two vertical sides extending inward from said vertical wall and joined by a vertically extending fold spaced a substantial distance inward from said vertical wall, said column spaced a substantial distance inward from said side edges of said vertical wall and positioned with the vertically extending fold under the weight bearing flange to support said fixture in said normal, upright orientation by transmitting the weight of said fixture from said upper weight bearing flange to said bottom floor wall through the folded portion of said column.

2. A unitary carton end as defined in claim 1 wherein said partial floor wall includes means for holding said one vertically extending fold of said column in a folded configuration.

3. A unitary carton end as defined in claim 1 wherein said column is formed of corrugated cardboard material, the corrugation axis of said material having a direction vector which is collinear with the axis of said column.

4. A unitary carton end as defined in claim 1 additionally comprising:

a partial top wall formed of sheet material extending unitarily from said vertical wall and formed of at least three layers of said sheet material; and a pair of partial side walls formed of said sheet material and extending unitarily from said vertical wall, each of said side walls affixed to said floor wall and said top wall.

5. A unitary carton end as defined in claim 1 wherein said vertically extending column is formed as an extension of a flap extending unitarily from said vertical wall, said flap additionally folding to form a partial side wall for said carton end.

6. A unitary carton end as defined in claim 1 wherein said vertically extending column is formed as a flat sheet of said sheet material and includes at least one fold line, said fold line adapted to be folded to form said column after placement of said carton end on said enclosed fixture.

7. A unitary carton end for supporting an upper weight bearing flange of an enclosed fixture having a top and bottom, comprising:

a vertical wall formed of sheet material;

a partial bottom floor wall formed of sheet material extending unitarily from said vertical wall and positioned adjacent said bottom of said fixture;

a vertically extending column formed unitarily of sheet material with said vertical wall, said column abutting said floor wall at one end and said weight bearing flange at the other end, said column including at least one vertically extending fold; and said partial floor wall including means for holding said one vertically extending fold of said column in a folded configuration, comprising a recessed pocket on one surface of said partial floor wall conforming to the perimeter of said column and positioned around said column.

8. A carton blank for forming one end of a carton for enclosing a device, comprising:

a flat end wall portion including four linear sides;

three flaps extending unitarily from three of said four linear sides of said end wall portion;

a fourth flap extending unitarily from the remaining linear side of said end wall portion, said fourth flap including an extension for forming a hollow column within said carton end for bearing the weight of said enclosed device, said column including at least one fold line in the direction of the weight of said device; and one of said three flaps including means for holding said hollow column folded about said fold line, comprising a recess in said one of said three flaps.

* * * * *

UNITED STATES PATENT OFFICE

CERTIFICATE OF CORRECTION

Patent No. 3,999,658 Dated December 28, 1976

Inventor(s) Leo J. Anderson

It is certified that error appears in the above-identified patent and that said Letters Patent are hereby corrected as shown below:

Column 2, line 5, delete "supporting" and insert --surrounding--

Column 4, line 43, delete "these" and insert --three--

Column 4, line 49, delete "81, 37, 85 and insert --81, 83, 85

Column 4, line 50, delete "83" and insert --37--

Column 10, line 20, delete "said carton end"

Column 10, line 21, after "fixture," and before "comprising", insert ---said carton end---

Signed and Sealed this

Thirty-first Day of May 1977

[SEAL]

*Attest:*

RUTH C. MASON
*Attesting Officer*

C. MARSHALL DANN
*Commissioner of Patents and Trademarks*